US006588135B1

(12) United States Patent
LeKay

(10) Patent No.: US 6,588,135 B1
(45) Date of Patent: Jul. 8, 2003

(54) FIRM ENGAGEMENT SIGN HOLDER APPARATUS FOR SIGN SHEETS

(76) Inventor: Anthony G. LeKay, 2480 Del Lago Dr., Ft. Lauderdale, FL (US) 33316

( * ) Notice: Subject to any disclaimer, the term of this patent is extended or adjusted under 35 U.S.C. 154(b) by 0 days.

(21) Appl. No.: 10/183,964

(22) Filed: Jun. 27, 2002

(51) Int. Cl.[7] ..... G09F 3/20

(52) U.S. Cl. ..... 40/649; 40/611; 40/650; 40/358; 40/617

(58) Field of Search ..... 40/611, 650, 649, 40/661, 358, 617

(56) References Cited

U.S. PATENT DOCUMENTS

| | | | | | |
|---|---|---|---|---|---|
| 882,244 | A | * | 3/1908 | Gibson | 40/617 |
| 978,218 | A | * | 12/1910 | Sargent | 40/617 |
| 1,863,633 | A | * | 6/1932 | Melind | 40/661.11 |
| 2,815,594 | A | * | 12/1957 | Heselov | 40/650 |
| 3,846,925 | A | * | 11/1974 | Busse | 40/650 |
| 4,334,372 | A | * | 6/1982 | Colmar | 40/650 |
| 4,775,058 | A | * | 10/1988 | Yatsko | 40/650 |
| 5,881,484 | A | * | 3/1999 | Carroll | 40/649 |

* cited by examiner

*Primary Examiner*—Gary Hoge
(74) *Attorney, Agent, or Firm*—Frank L. Kubler

(57) ABSTRACT

A sign holder apparatus includes a sign sheet receiving channel having opposing channel side walls extending forwardly from and interconnected by a sheet abutment panel having a forward sheet abutment surface, the channel side walls having substantially parallel edge receiving grooves angled and opening toward each other and toward the sheet abutment surface; a flexible and resilient sign sheet sized to slide into the sign sheet receiving channel from an end of the sign sheet receiving channel with opposing sign sheet edges simultaneously sliding into the edge receiving grooves, the angles of the edge receiving grooves relative to the sheet abutment surface bowing the sign sheet against the sheet abutment surface such that friction between the sheet edges and the edge receiving grooves and between the sign sheet and the sheet abutment surface firmly retains the sign sheet against unwanted sliding out of the receiving channel.

15 Claims, 7 Drawing Sheets

FIRM ENGAGEMENT SIGN HOLDER APPARATUS FOR SIGN SHEETS

BACKGROUND OF THE INVENTION

1. Field of the Invention

The present invention relates generally to the field of sign holders for releasably retaining and displaying sign sheets printed with images or words, such as table top item identification signs. More specifically the present invention relates to a channel sign holder apparatus including a substantially rectangular sign sheet receiving channel having opposing channel side walls extending forwardly from and interconnected by a substantially rectangular sheet abutment panel having a forward sheet abutment surface, the channel side walls having sheet edge receiving grooves opening at an angle toward each other and toward the sheet abutment surface. A flexible and resilient sign sheet having two substantially parallel opposing sheet edges is provided which is sized to slide into the receiving channel from an end of the receiving channel with the opposing sheet edges simultaneously sliding into the edge receiving grooves. The angled orientation of the edge receiving grooves relative to the sheet abutment surface bows the sign sheet flat against the sheet abutment surface so that friction between the sheet edges and the edge receiving grooves and between a rearward face of the sign sheet and the sheet abutment surface firmly retains the sign sheet against sliding out of the receiving channel with the force of its own weight when the apparatus is handled and tilted, and yet permits manual sliding of the sign sheet out of the receiving channel, such as to insert another sign sheet. The sign sheet does not truly bow, because it flattens against the abutment surface. A transparent cover sheet is optionally provided to cover the sign sheet to protect the sign sheet from damage.

2. Description of the Prior Art

There have long been sign holders in the form of sign sheet receiving channels having parallel and opposing longitudinal channel walls with opposing edge receiving grooves opening directly toward each other for receiving opposing edges of a sign sheet printed with writing or images, so that the sign sheet is removably retained and displayed within the receiving channel. Typical prior art edge receiving grooves are designed to accept 0.060 inch thick engravable sign material and not the current thinner range of sign sheet material used in modern graphics.

A problem with these prior sign holders has been that the sign sheets are not retained against lateral sliding and can slide part or all the way out of the channel when the sign holder is handled and moved. Another problem has been that the sign sheets can become slightly rotated within the edge receiving grooves so that the sign sheet appears crooked or misaligned with the sign holder. Another problem is that sign sheet materials are not uniform in thickness and will vary in thickness depending on the different types and different manufacturers of the sign sheet. While it is possible to limit unwanted sign sheet displacement within the sign holder by making the edge receiving grooves narrow enough to effectively grip sign sheet edges, sign sheet material is not readily compressible and the tight fit makes inserting the sign sheets into the sign holder difficult at best, and more often results in bends and creases in the sign sheet resulting from attempted and unsuccessful insertion.

One example of a prior sign sheet holder is that of Healy, U.S. Pat. No. 6,308,446, issued on Oct. 30, 2001, disclosing a sign system including a chassis for supporting a backing sheet to provide a stable platform, and a magnetic backing sheet having magnetic tape which is attached to the chassis to function as a frame for the sign inserts. A light transmitting protective sheet may cover the sign inserts. The sign inserts or cover sheet contain a thin coating of material which is magnetically attracted to the magnetic backing sheet so that the inserts are retained on a sign.

Another sign sheet holder is revealed in Healy, U.S. Pat. No. Des. 435,270, issued on Dec. 19, 2000, for a sign having a concavely arched support panel standing mostly upright on a rearwardly extending support leg and having cylindrical upper and lower panel walls along support panel horizontal edges. Since Des. 435,270 is a design patent, there is no explanation of how a sign sheet may be retained.

It is thus an object of the present invention to provide a sign holder apparatus which removably receives and displays a sign sheet printed with words or images and which retains the sign sheet with a firm friction grip until removed by manual force.

It is another object of the present invention to provide a sign holder apparatus which can receive and firmly retain any of several thicknesses of sign sheet.

It is yet another object of the present invention to provide such a sign holder apparatus for which sign sheet insertion and removal is easy and which causes little or no deformation of the sign sheet, and which can additionally retain a transparent cover sheet in front of the sign sheet.

It is still another object of the present invention to provide such a sign sheet apparatus which can stand upright on a horizontal support surface or can be secured upright to a vertical surface, or which can include a chain from which the apparatus can be suspended from an object or vertical surface.

It is finally an object of the present invention to provide such a sign holder apparatus which sturdy, attractive and economical to manufacture.

SUMMARY OF THE INVENTION

The present invention accomplishes the above-stated objectives, as well as others, as may be determined by a fair reading and interpretation of the entire specification.

A sign holder apparatus is provided, including a sign sheet receiving channel having opposing channel side walls extending forwardly from and interconnected by a sheet abutment panel having a forward sheet abutment surface, the channel side walls having substantially parallel edge receiving grooves angled and opening toward each other and toward the sheet abutment surface; a flexible and resilient sign sheet sized to slide into the sign sheet receiving channel from an end of the sign sheet receiving channel with opposing sign sheet edges simultaneously sliding into the edge receiving grooves, the angles of the edge receiving grooves relative to the sheet abutment surface bowing the sign sheet against the sheet abutment surface such that friction between the sheet edges and the edge receiving grooves and between the sign sheet and the sheet abutment surface firmly retains a range of thickness of material of the sign sheet against sliding out of the receiving channel with the force of its own weight when the apparatus is handled and tilted, and yet permits manual sliding of the sign sheet out of the sign sheet receiving channel.

The angles of the edge receiving grooves relative to the sheet abutment surface preferably are each substantially 30 degrees. The angles of the edge receiving grooves relative to the sheet abutment surface alternatively are each at least 15 degrees. Each edge receiving groove preferably is substantially rectilinear along its depth.

At least one of the edge receiving grooves optionally is curved along its depth. The sign holder optionally additionally includes a level support surface support structure, or optionally additionally includes an upright support surface support structure. A support surface support structure optionally includes two ring ports in the sheet abutment panel upper end, above the edge receiving grooves, a chain engagement ring passing through each ring port, and a chain engaged by the rings, the chain having sufficient length to arch upwardly above the sheet receiving channel for hooking over an upright support structure. The level support surface support structure preferably includes a leg structure joined to and intersecting a middle region of the sheet abutment panel, and extending rearwardly and downwardly from the sheet abutment panel, so that the leg panel extends to abutment with a level support surface when the sheet abutment panel is tilted rearwardly. The sign holder optionally additionally includes a transparent cover sheet sized to fit into the receiving channel for covering the sign sheet to protect the sign sheet from damage.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
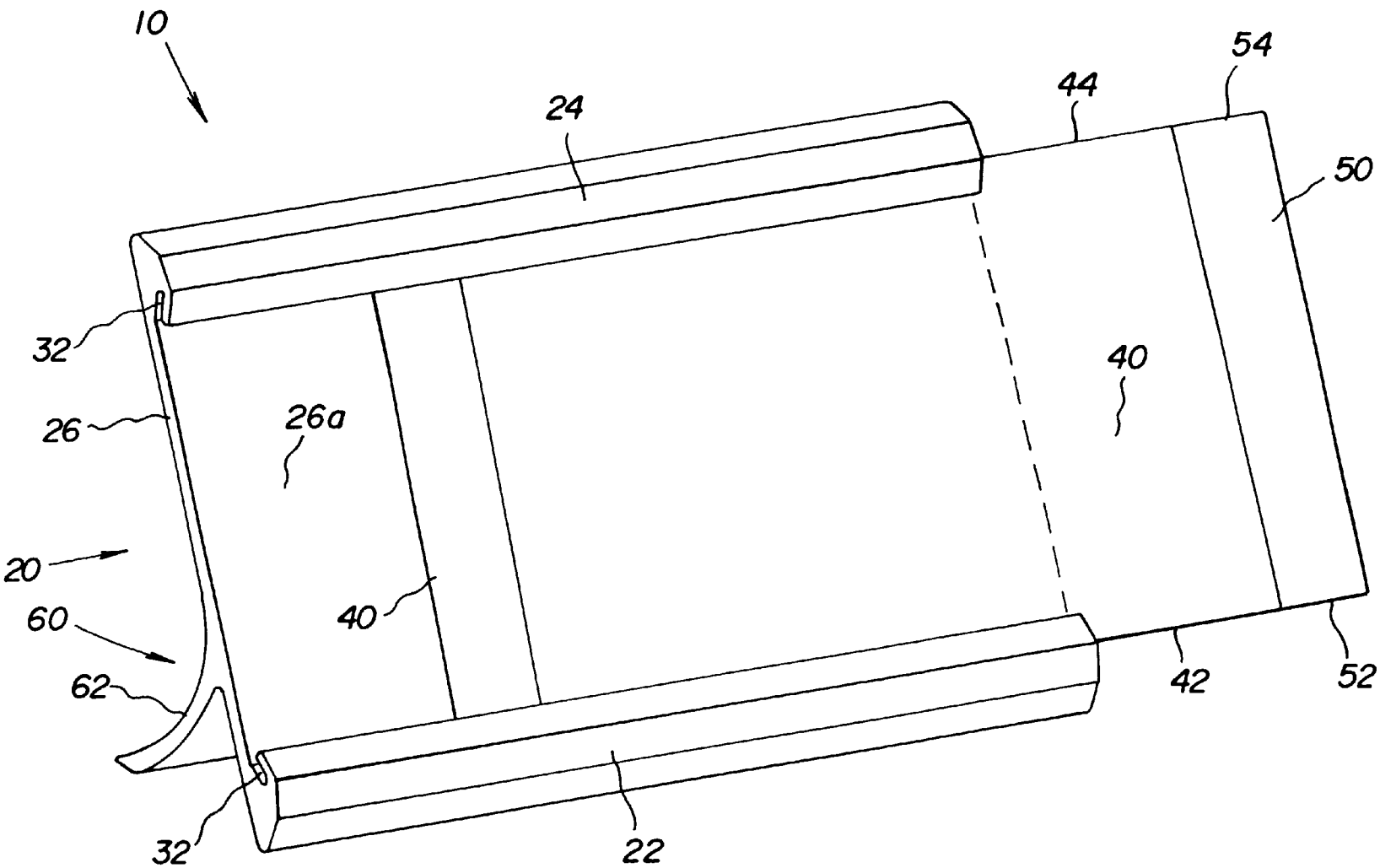
FIG. 1 is a front perspective view of the preferred embodiment of the present sign holder apparatus having a support surface support structure and retaining a sign sheet and a cover sheet in the sheet receiving channel, the sign sheet and cover sheet being partly displaced out of the receiving channel for purposes of illustration.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–7, a channel sign holder apparatus 10 is disclosed, including a substantially rectangular sign sheet receiving channel 20 having opposing channel side walls 22 and 24 extending forwardly from and interconnected by a substantially rectangular sheet abutment panel 26 having a forward sheet abutment surface 26*a*, the channel side walls 22 and 24 having sheet edge receiving grooves 32 opening at an angle toward each other and toward the sheet abutment surface 26*a*. A flexible and resilient sign sheet 40 having two substantially parallel opposing sheet edges 42 and 44 is provided which is sized to slide into the receiving channel 20 from an end of the receiving channel 20 parallel to the channel side walls 22 and 24 with the opposing sheet edges 42 and 44 simultaneously sliding into edge receiving grooves 32, the angled orientation of the edge receiving grooves 32 relative to the sheet abutment surface 26*a* bowing the sign sheet 40 flat against the sheet abutment surface 26*a* so that friction between the sheet edges 42 and 44 and the edge receiving grooves 32, and between a rearward face of the sign sheet 40 and the sheet abutment surface 26*a*, firmly retains the sign sheet 40 against sliding out of the receiving channel 20 with the force of its own weight when apparatus 10 is handled and tilted, and yet permits manual sliding of the sign sheet 40 out of the receiving channel 20, such as to insert another sign sheet 40. The friction of the rearward surface of sign sheet 40 against abutment surface 26*a* becomes progressively greater as it approaches the midline of the abutment surface 26*a* between channel side walls 22 and 24. Once again, the sign sheet 40 does not truly bow into an arch, because it flattens against the abutment surface 26*a*. The depth of the edge receiving grooves 32 must be sufficient to substantially align the sheet edges 42 and 44 with the orientation of the grooves 32 and thus to produce the necessary sign sheet 40 bowing.

A transparent cover sheet 50 is optionally provided to cover the sign sheet 40 and protect sign sheet 40 from damage. Cover sheet 50 preferably is sized to match the length and height of the sign sheet 40, having opposing and substantially parallel cover sheet edges 52 and 54, and is inserted into the channel 20 over sign sheet 40 so that both sign sheet 40 and cover sheet 50 are retained against unwanted sliding within the channel 20 by the same angled groove 32 friction retaining mechanism. The width of edge receiving grooves 32, of course, must be selected to simultaneously receive a sign sheet 40 having any of a range of thicknesses and the thickness of cover sheet 50.

Figure 7:
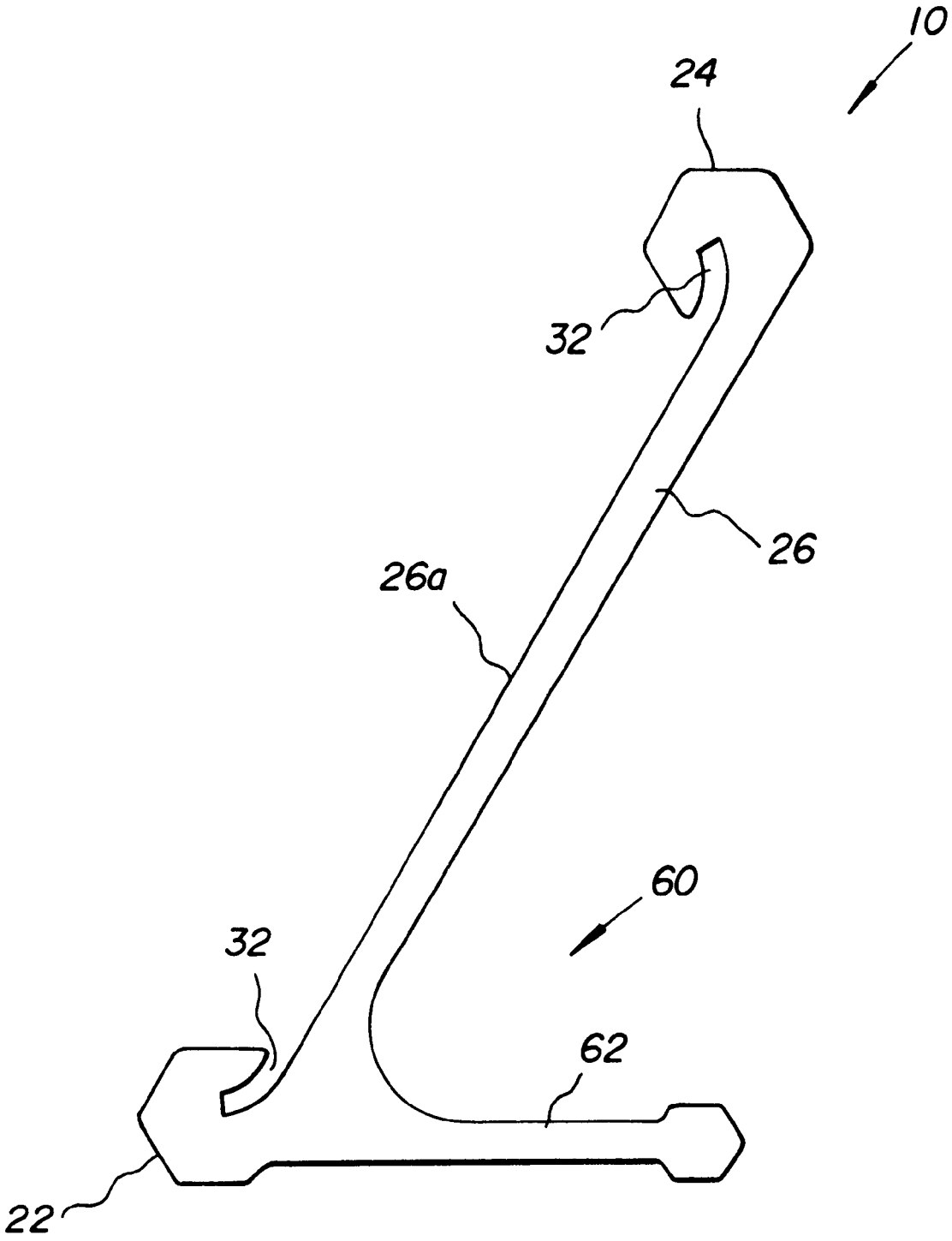
FIG. 7 is an end view of a variation of the first embodiment having edge receiving grooves, each edge receiving groove being curved along its depth.

The angles of each of the edge receiving grooves 32 relative to the sheet abutment surface 26*a* preferably is substantially 30 degrees, and for most applications an angle of at least 15 degrees is needed for adequate bowing and resulting sign sheet 40 friction engagement. Furthermore, while it is preferred that the grooves 32 be rectilinear in the direction of depth, grooves 32 which are curved in one or more directions, or are further angled along their depth in multiple directions are contemplated, and an example of the curved version is illustrated in FIG. 7.

Sign sheet receiving channel 20 includes either a support surface structure 60 or a chain support structure 70. The support surface structure 60 preferably takes the form of a leg panel 62 joined to and intersecting a middle region of sheet abutment panel 26 along a line substantially parallel with channel side walls 22 and 24, and extending rearwardly and downwardly from the mid-region of the sheet abutment panel 26 so that the leg panel 62 extends to abutment with a table top or other support surface when the sheet abutment panel 26 is tilted a desired number of degrees rearwardly. The leg panel 62 preferably has a stylized and ornamental downward curve, as illustrated. See FIGS. 1–4. Alternatively the leg panel may extend from other points and in other directions to accomplish the same propping function, such as straight back from the bottom edge of receiving channel 22, as shown in FIG. 5.

Figure 2:
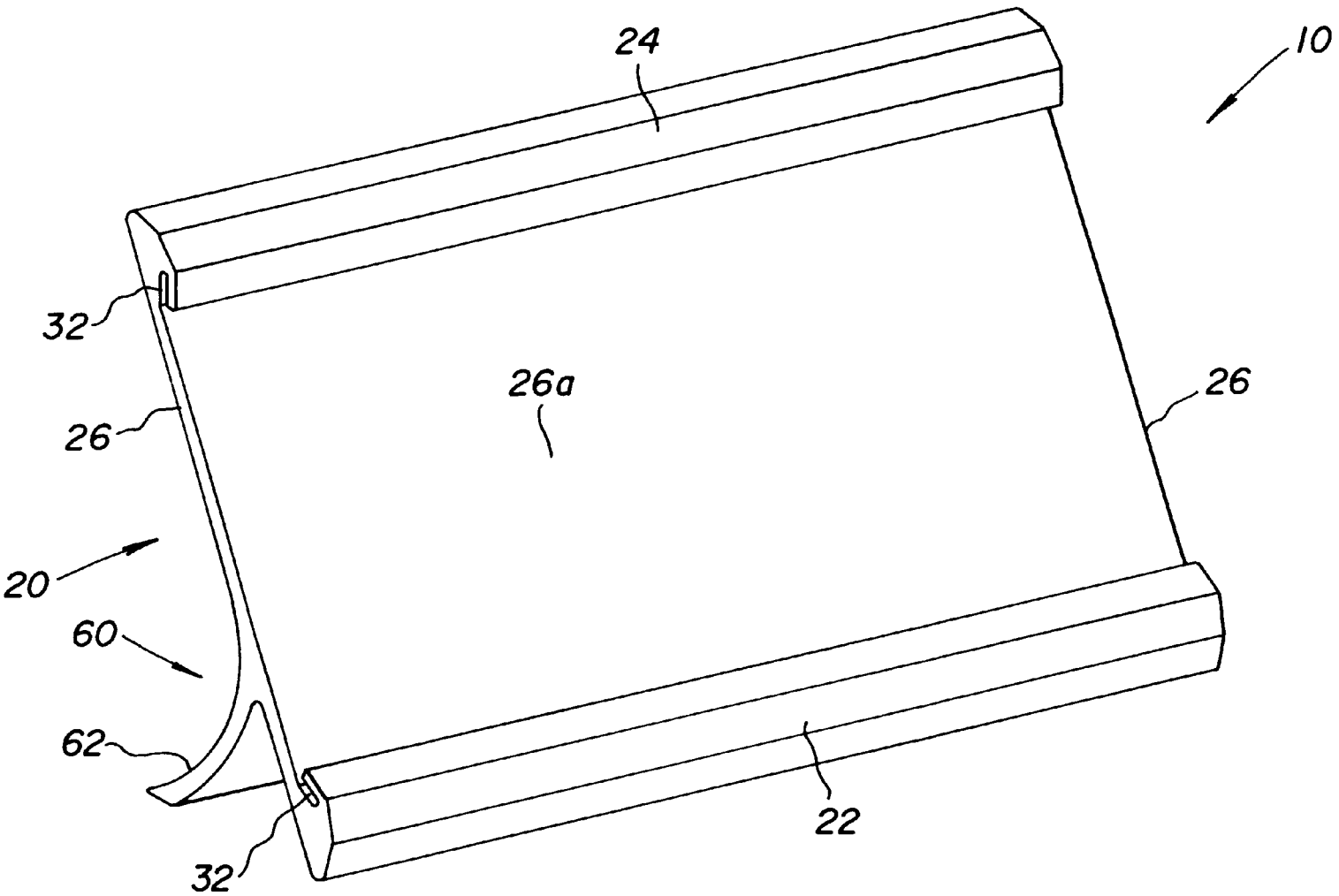
FIG. 2 is a view as in FIG. 1 with the sign sheet and cover sheet removed.
Figure 3:
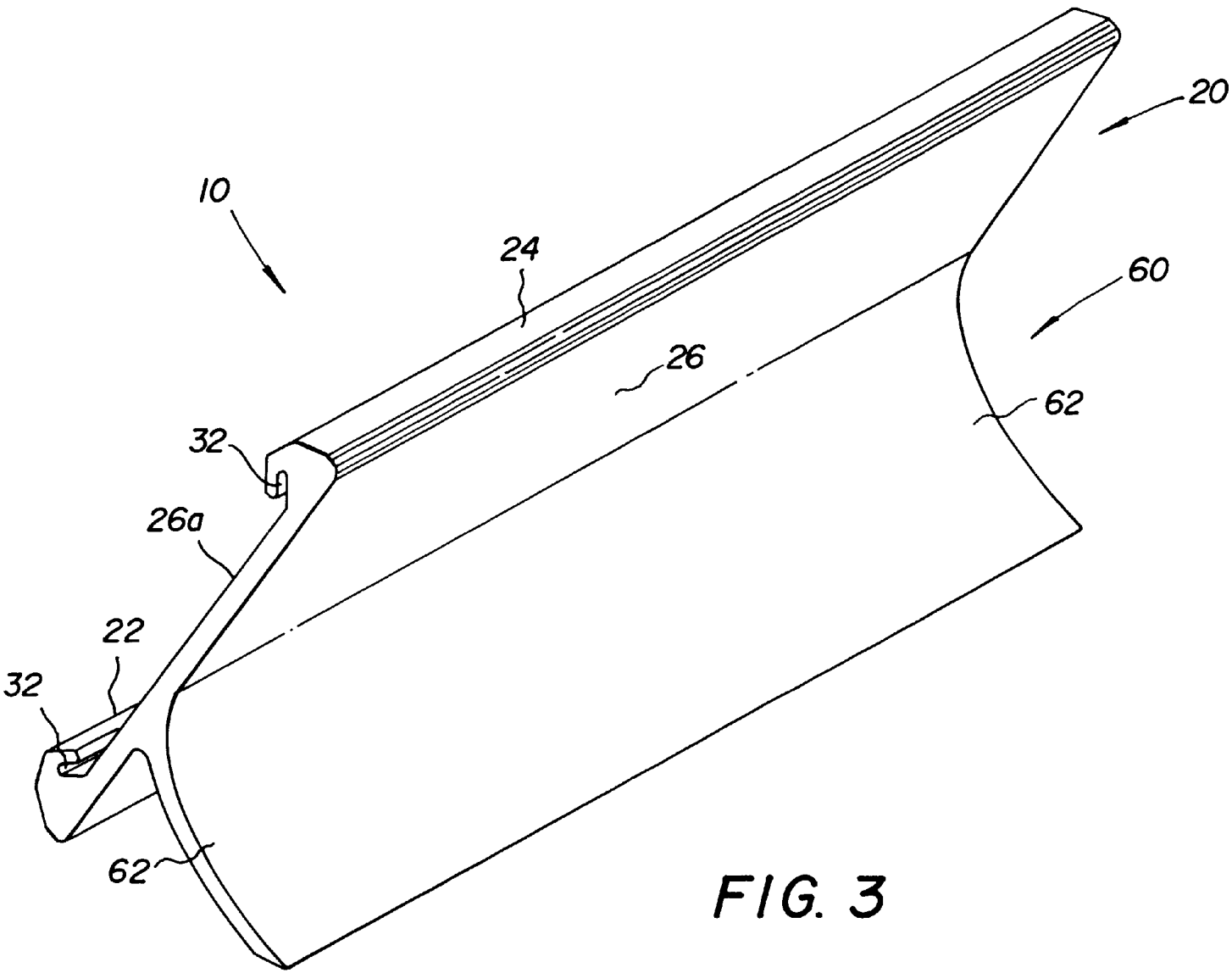
FIG. 3 is a rear perspective view of the apparatus of FIG. 1.
Figure 4:
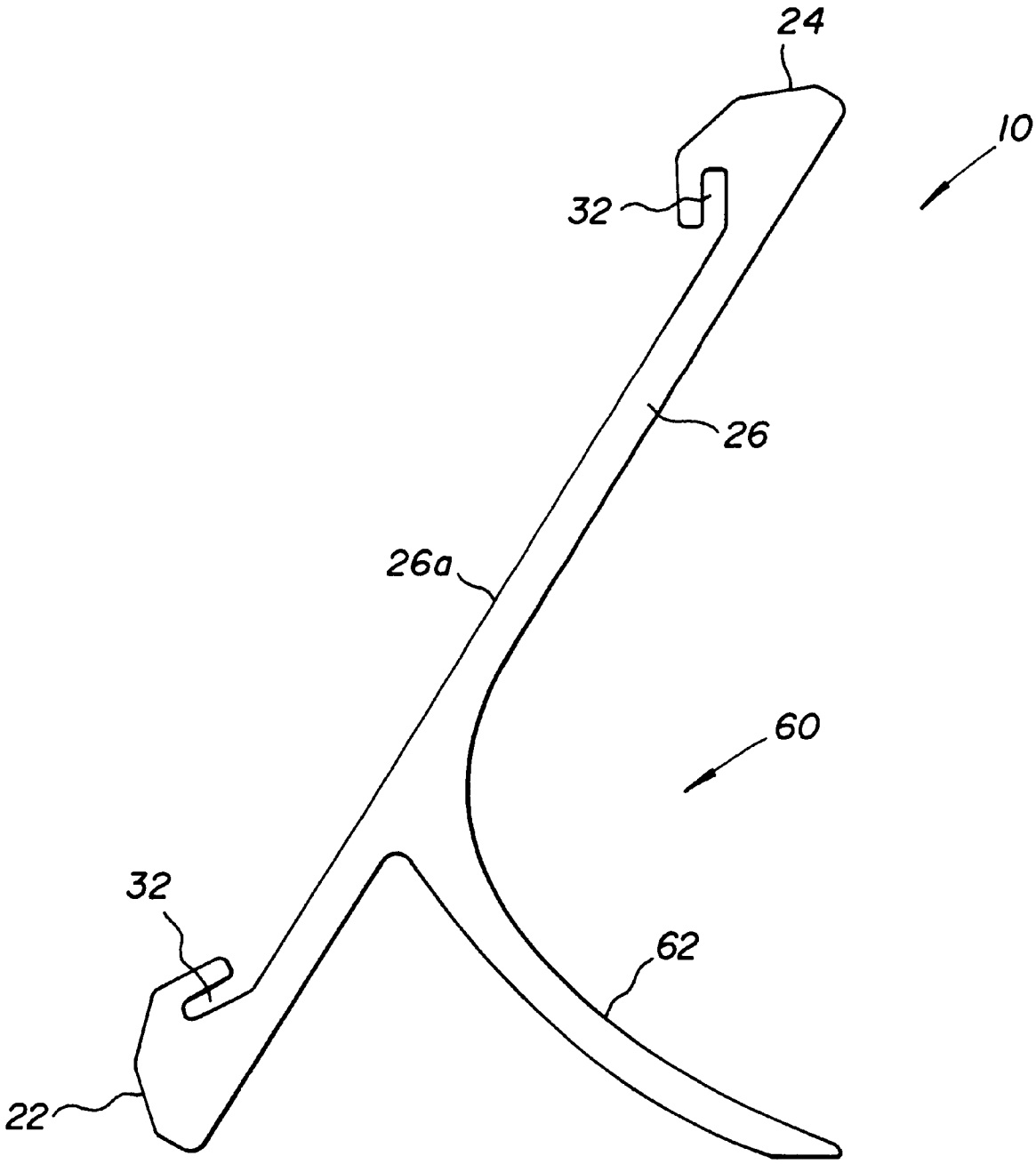
FIG. 4 is an end view of the preferred embodiment, showing an example of the angling of the edge receiving grooves relative to the sheet abutment surface.
Figure 5:
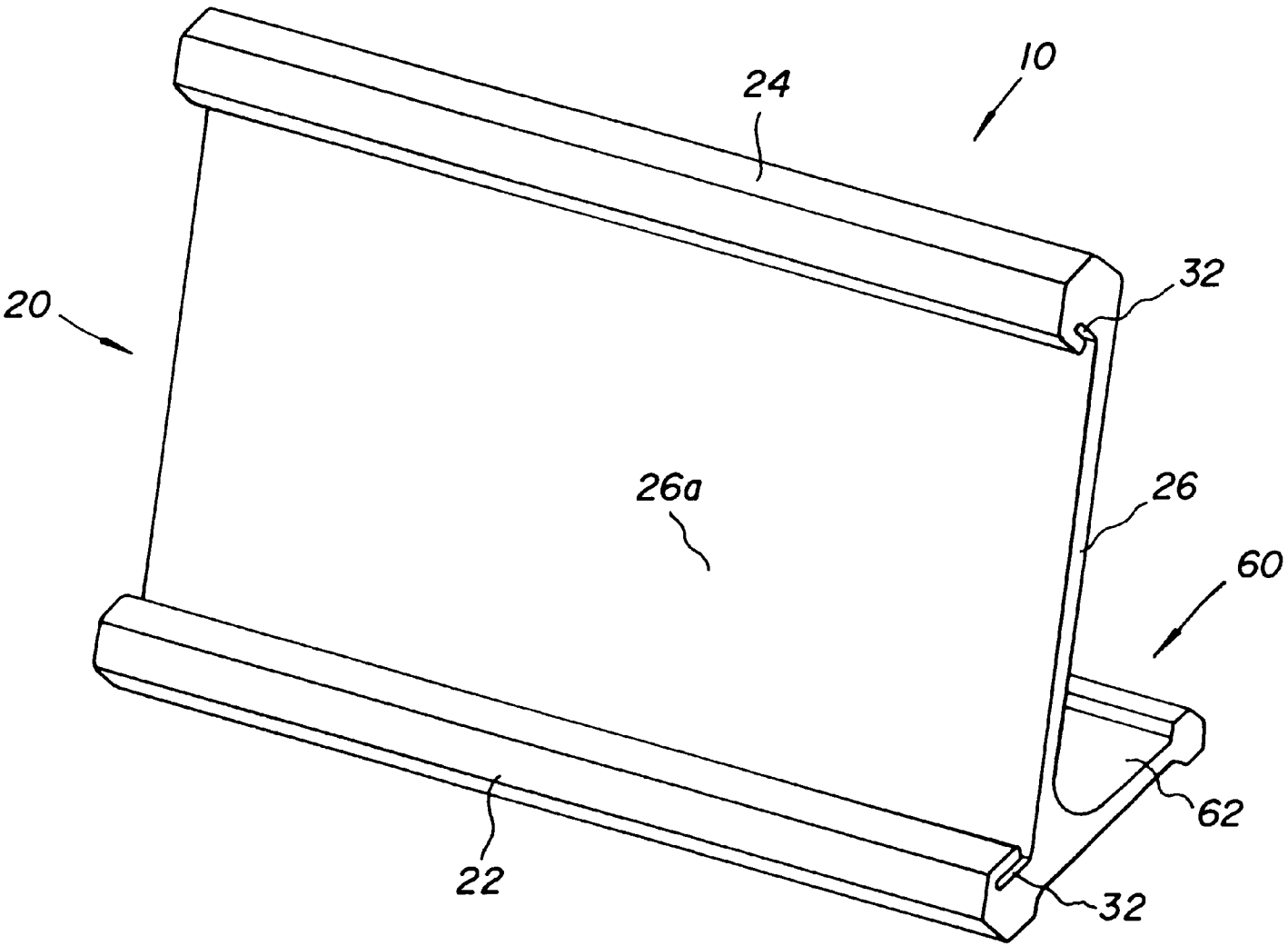
FIG. 5 is a front perspective view of a variation of the first embodiment having an alternative leg panel design extending horizontally rearward from the channel lower edge.
Figure 6:
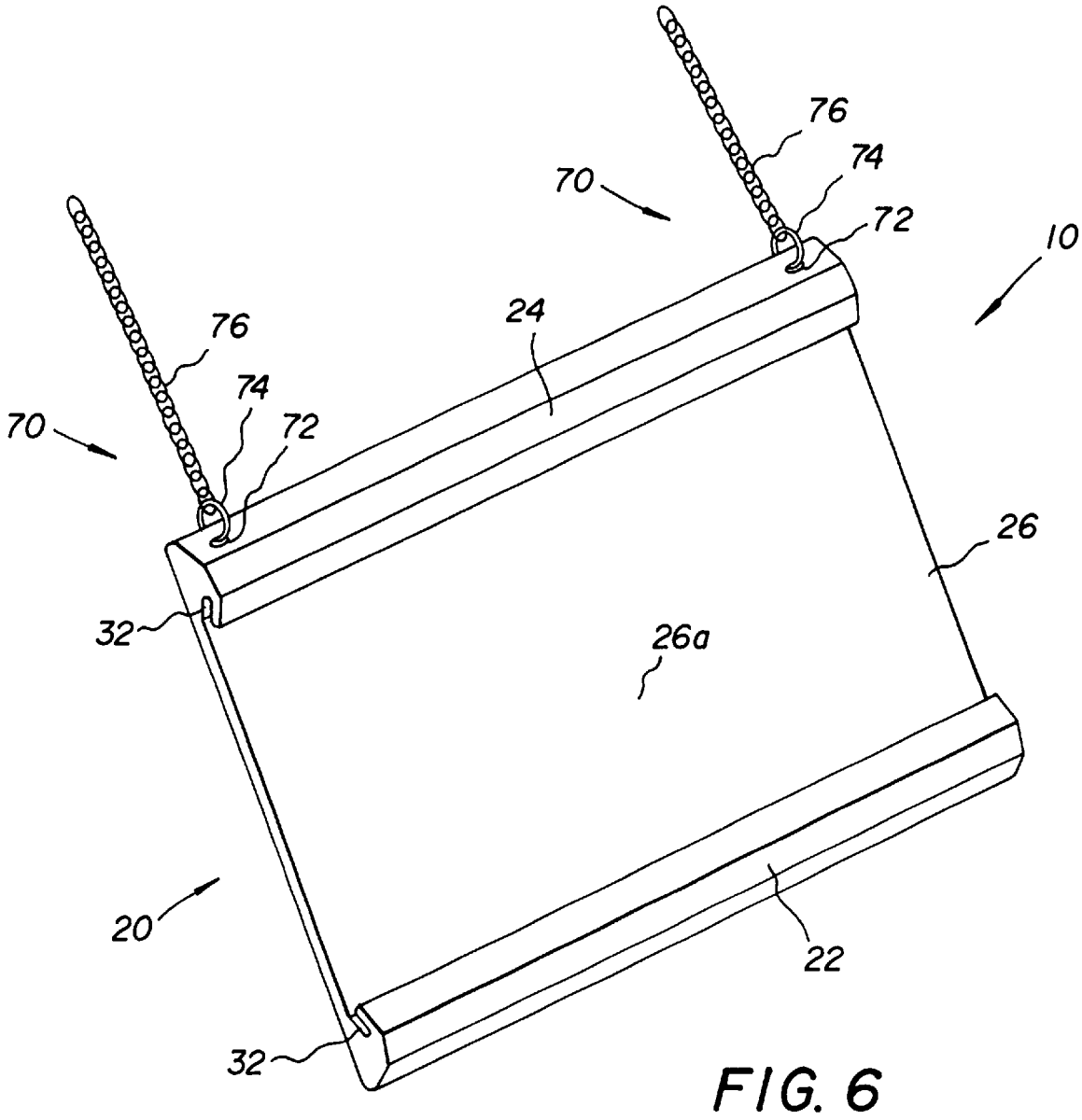
FIG. 6 is a front perspective view of the preferred embodiment of the apparatus having an upright support surface support structure.

It is contemplated that the inventive sign holder apparatus 10 of virtually any embodiment, such as that illustrated in FIGS. 2 or 5, alternatively may be oriented on a support surface so that channel side wall 24 is tilted down to rest on the support surface while the rearward end of leg panel 62 also rests on the support surface, and channel side wall 22 is elevated and higher than channel side wall 24. The purpose of this alternative orientation of sign holder apparatus 10 is to provide a different, perhaps more acute angle of sign sheet 40 display so that a person standing close to and over apparatus 10 can see the sign sheet 40 more directly, or more perpendicular to his or her line of sight. The claims are understood of course to completely cover apparatus 10 in this orientation as well, since the structure of apparatus 10 is unaltered.

The chain support structure 70 omits the leg panel 62 and adds two spaced apart ring ports 72 in the sheet abutment panel 26 upper end, above the edge receiving grooves 32, a chain anchor ring 74 passing through each ring port 72, and a chain 76 with two chain 76 ends engaged by the opposing rings 74, the chain 76 having sufficient length to bow upwardly above the receiving channel 20 and hook over a support structure. See FIG. 7. Alternatively a wall support structure may take the form of double-sided tape (not shown) secured to the rear face of sheet abutment panel 26, such as to fasten apparatus 10 to a clip, a stand or a container.

Sign holder apparatus 10 may be of virtually any length, and preferably is extruded. Sign holder apparatus 10 preferably is formed of aluminum or plastic body. The optional cover sheet 50 preferably is formed of clear non-glare polycarbonate material.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A sign holder apparatus, comprising:

a sign sheet receiving channel having opposing channel side walls extending forwardly from and interconnected by a sheet abutment panel having a forward sheet abutment surface, said channel side walls having substantially parallel edge receiving grooves angled and opening toward each other and toward said sheet abutment surface;

a flexible and resilient sign sheet sized to slide into said sign sheet receiving channel from an end of said sign sheet receiving channel with opposing sign sheet edges simultaneously sliding into said edge receiving grooves, the angles of said edge receiving grooves relative to said sheet abutment surface bowing said sign sheet against said sheet abutment surface such that friction between said sheet edges and said edge receiving grooves and between said sign sheet and said sheet abutment surface firmly retains said sign sheet against sliding out of said receiving channel with the force of its own weight when said apparatus is handled and tilted, and yet permits manual sliding of said sign sheet out of said sign sheet receiving channel;

wherein each said edge receiving groove is substantially rectilinear along its depth.

2. The sign holder apparatus of claim 1, wherein the angles of said edge receiving grooves relative to said sheet abutment surface are each substantially 30 degrees.

3. The sign holder apparatus of claim 1, wherein the angles of said edge receiving grooves relative to said sheet abutment surface are each at least 15 degrees.

4. The sign holder apparatus of claim 1, additionally comprising a support structure extending generally horizontally from said sign sheet receiving channel for propping said sign sheet receiving channel upright on a level support surface.

5. The sign holder apparatus of claim 1, additionally comprising a support structure for connecting said sign sheet receiving channel to an upright support surface and for supporting said sign sheet receiving channel in an upright orientation.

6. The sign holder of claim 5, wherein said support structure comprises two ring ports in said sheet abutment panel upper end, above said edge receiving grooves, a chain engagement ring passing through each said ring port, and a chain engaged by said rings, said chain having sufficient length to arch upwardly above said sheet receiving channel for hooking over an upright support structure.

7. The sign holder of claim 4, wherein said support structure comprises a leg means joined to and intersecting a middle region of said sheet abutment panel, and extending rearwardly and downwardly from said sheet abutment panel, such that said leg panel extends to abutment with a level support surface when said sheet abutment panel is tilted rearwardly.

8. The sign holder of claim 1, additionally comprising a transparent cover sheet sized to fit into said receiving channel for covering said sign sheet to protect said sign sheet from damage.

9. A sign holder apparatus, comprising:

a sign sheet receiving channel having opposing channel side walls extending forwardly from and interconnected by a sheet abutment panel having a substantially planar forward sheet abutment surface, said channel side walls having substantially parallel edge receiving grooves angled and opening toward each other and toward said sheet abutment surface, at least one said edge receiving groove being substantially rectilinear along its depth;

a flexible and resilient sign sheet within said sign sheet receiving channel with opposing sign sheet edges simultaneously retained within said edge receiving grooves, the angles of said edge receiving grooves relative to said sheet abutment surface bowing said sign sheet against said sheet abutment surface such that friction between said sheet edges and said edge receiving grooves and between said sign sheet and said sheet abutment surface firmly retains said sign sheet against sliding out of said receiving channel with the force of its own weight when said apparatus is handled and tilted, and yet permits manual sliding of said sign sheet out of said sign sheet receiving channel.

10. The sign holder of claim 9, additionally comprising a transparent cover sheet within said receiving channel forward of said sign sheet having cover sheet edges simultaneously retained within said edge receiving grooves for covering said sign sheet to protect said sign sheet from damage.

11. A sign holder apparatus, comprising:

a sign sheet receiving channel having opposing channel side walls extending forwardly from and interconnected by a sheet abutment panel having a substantially planar forward sheet abutment surface, said channel side walls having substantially parallel edge receiving grooves opening toward each other and toward said sheet abutment surface, at least one of said edge receiving grooves being transversely curved from its opening inwardly along its depth such that said at least one edge receiving groove arches forwardly;

a flexible and resilient sign sheet within said sign sheet receiving channel with opposing sign sheet edges simultaneously retained within said edge receiving grooves, the angles of said edge receiving grooves relative to said sheet abutment surface bowing said sign sheet against said sheet abutment surface such that friction between said sheet edges and said edge receiving grooves and between said sign sheet and said sheet abutment surface firmly retains said sign sheet against sliding out of said receiving channel with the force of its own weight when said apparatus is handled and tilted, and yet permits manual sliding of said sign sheet out of said sign sheet receiving channel.

12. The sign holder of claim 11, additionally comprising a transparent cover sheet within said receiving channel forward of said sign sheet having cover sheet edges simultaneously retained within said edge receiving grooves for covering said sign sheet to protect said sign sheet from damage.

13. A sign holder apparatus, comprising:

a sign sheet receiving channel having opposing channel side walls extending forwardly from and interconnected by a sheet abutment panel having a forward sheet abutment surface, said channel side walls having substantially parallel edge receiving grooves opening toward each other and toward said sheet abutment surface, each said edge receiving groove having a forward groove wall and a rearward groove wall, at least one of said edge receiving grooves being transversely curved from its opening inwardly along its depth such that said at least one edge receiving groove arches forwardly and having a transversely convex forward groove wall and transversely concave rearward groove wall;

a flexible and resilient sign sheet within said sign sheet receiving channel with opposing sign sheet edges simultaneously retained within said edge receiving grooves, the angles of said edge receiving grooves relative to said sheet abutment surface bowing said sign sheet against said sheet abutment surface such that friction between said sheet edges and said edge receiving grooves and between said sign sheet and said sheet abutment surface firmly retains said sign sheet against sliding out of said receiving channel with the force of its own weight when said apparatus is handled and tilted, and yet permits manual sliding of said sign sheet out of said sign sheet receiving channel.

14. A sign holder apparatus, comprising:

a sign sheet receiving channel having opposing channel side walls extending forwardly from and interconnected by a sheet abutment panel having a forward sheet abutment surface having an abutment surface radius of curvature from a point forward of said abutment surface, said channel side walls having substantially parallel edge receiving grooves having groove open ends opening toward each other and toward said sheet abutment surface, at least one of said edge receiving grooves being transversely curved from its open end along its depth such that at least a portion of said at least one edge receiving groove arches forwardly from its open end with an edge receiving groove radius of curvature from a point forward of said abutment surface having a shorter radial length than said abutment surface radius of curvature;

a flexible and resilient sign sheet within said sign sheet receiving channel with opposing sign sheet edges simultaneously retained within said edge receiving grooves, the shorter radial length of said edge receiving groove radius of curvature relative to the length of said abutment surface radius of curvature causing said sign sheet to bow against said sheet abutment surface such that friction between said sheet edges and said edge receiving grooves and between said sign sheet and said sheet abutment surface firmly retains said sign sheet against sliding out of said receiving channel with the force of its own weight when said apparatus is handled and tilted, and yet permits manual sliding of said sign sheet out of said sign sheet receiving channel.

15. The sign holder of claim 14, additionally comprising a transparent cover sheet within said receiving channel forward of said sign sheet having cover sheet edges simultaneously retained within said edge receiving grooves for covering said sign sheet to protect said sign sheet from damage.

* * * * *